US008787118B2

(12) United States Patent
Beccia et al.

(10) Patent No.: US 8,787,118 B2
(45) Date of Patent: Jul. 22, 2014

(54) UNIVERSAL WATCH

(71) Applicant: Blancpain S.A., Le Brassus (CH)

(72) Inventors: Vincent Beccia, Pully (CH); Nicolas Debaud, Puidoux (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 13/923,692

(22) Filed: Jun. 21, 2013

(65) Prior Publication Data

US 2013/0343163 A1 Dec. 26, 2013

(30) Foreign Application Priority Data

Jun. 26, 2012 (EP) ..... 12173574

(51) Int. Cl.
*G04B 19/22* (2006.01)

(52) U.S. Cl.
CPC ..... *G04B 19/22* (2013.01); *G04B 19/223* (2013.01)
USPC ..... 368/27

(58) Field of Classification Search
CPC ..... G04B 19/22; G04B 19/223
USPC ..... 368/21, 22, 27
See application file for complete search history.

(56) References Cited

U.S. PATENT DOCUMENTS

| | | | | |
|---|---|---|---|---|
| 1,046,246 | A * | 12/1912 | Albrecht | 368/21 |
| 2,535,543 | A * | 12/1950 | Maizlish et al. | 368/27 |
| 4,222,227 | A | 9/1980 | Arabian | |
| 8,199,612 | B2 * | 6/2012 | Jolidon | 368/223 |
| 2008/0198696 | A1 * | 8/2008 | Dias | 368/27 |

FOREIGN PATENT DOCUMENTS

DE 38 41 440 A1 6/1990

OTHER PUBLICATIONS

European Search Report issued Dec. 10, 2012 in Europe 12173574.0 filed Jun. 26, 2012 ( with English Translation).

* cited by examiner

*Primary Examiner* — Vit W Miska
(74) *Attorney, Agent, or Firm* — Oblon, Spivak, McClelland, Maier & Neustadt, L.L.P.

(57) ABSTRACT

A universal watch including a movement driving a main display means cooperating with a complementary main display means, a means for adjusting the main display means to set the time of a determined place, a secondary display means which is moveable relative to the complementary main display means, and comprises geographical reference points of different time zones. This movement drives synchronously with the main display means the secondary display means, and a structure carrying first screens, each superposed on a geographical reference point and, according to the time of day, changing position under the action of a drive torque from drive means which is greater than the resistant torque imparted thereon by friction means connected to the structure.

14 Claims, 6 Drawing Sheets

UNIVERSAL WATCH

This application claims priority from European Patent Application No. 12173574.0 filed Jun. 26, 2012, the entire disclosure of which is incorporated herein by reference.

FIELD OF THE INVENTION

The invention concerns a universal watch comprising a movement for driving a main time display means cooperating with a complementary main time display means, and comprising a means of adjusting said main time display means to set the time of a determined place, and further comprising a secondary display means, which is moveable relative to said complementary main time display means, said secondary display means comprising a plurality of geographical reference points for different time zones, said movement directly or indirectly driving both said secondary display means and a carrier structure in a synchronous manner with said main time display means.

The invention concerns the field of horology, and more specifically, among timepieces with multiple displays, universal watches whose dial is devised for the rapid reading of the time in different time zones.

BACKGROUND OF THE INVENTION

It is often awkward to read the time of a place in a given time zone in a watch, due to the division into 24 time zones, which means that there is an angular sector of small amplitude for each time zone.

A conventional solution, as seen in EP Patent No 0 579 093 B1 in the name of Cie des Montres Longines, Francillon S. A., juxtaposes a display means comprising a twenty-four hour-circle with an ordinary twelve hour display and with a time zone ring, relative to which the display means is moveable, driven by a rotating ring completing one revolution in twenty-four hours. A correction mechanism enables the hour hand to be corrected directly and independently, via action on the time-setting stem, without any action on the rotating ring and without any effect on the universal time.

WO Patent No 2009/121699 in the name of Glaschütter Unhrenbetrieb GmbH discloses a complication for the display of time zones on a second time zone display, distinct from the main current time display, and for the display of half-time zones used in some states in the world. This mechanism differentiates between summer time and winter time, and comprises a day/night indicator connected to the second time zone display. A time zone indicator comprises a place ring and an index which are moveable in relation to each other. Time setting corrections are possible, either independently for the main display and the second display, or for both together. A manual place corrector enables the place ring to be rotated step by step without changing the status of the main display and of the second display.

DE Patent Application No 38 41 440 A1 in the name of Zimmerman discloses a universal watch with a stator carrying twelve zone discs, each corresponding to two diametrically opposite time zones and all pivotally mounted on the same diameter of the stator. A rotor which is driven by the movement and coaxial to this stator causes synchronous pivoting, which makes reading awkward, and does not allow the only time zone concerned by a date change to be clearly displayed at a given time.

In addition to being cumbersome, these mechanisms are often complex, and occupy a significant portion of the thickness of the movement.

SUMMARY OF THE INVENTION

The invention proposes to improve the display of universal time in various cities or various reference places, by regrouping opposite time zones in the same display area. These opposite time zones are differentiated by a day/night display superposed on each city or reference place.

The invention therefore concerns a universal watch comprising a movement for driving a main time display means cooperating with a complementary main time display means, and comprising a means of adjusting said main time display means to set the time of a determined place, and further comprising a secondary display means which is moveable relative to said complementary main time display means, said secondary display means comprising a plurality of geographical reference points corresponding to different time zones, said movement directly or indirectly driving both said secondary display means and a carrier structure, in a synchronous manner with said main time display means, characterized in that said carrier structure carries a plurality of first screens each superposed on one of said geographical reference points and capable of occupying several different positions according to the time of day and changes from one position to the other under the action of first drive means imparting a torque or drive force thereon greater than, respectively, a torque or resistant force imparted thereon by a first friction means connected to said carrier structure.

BRIEF DESCRIPTION OF THE DRAWINGS

Other features and advantages of the invention will appear in the following detailed description, with reference to the annexed drawings, in which.

DETAILED DESCRIPTION OF PREFERRED EMBODIMENTS

Figure 1:
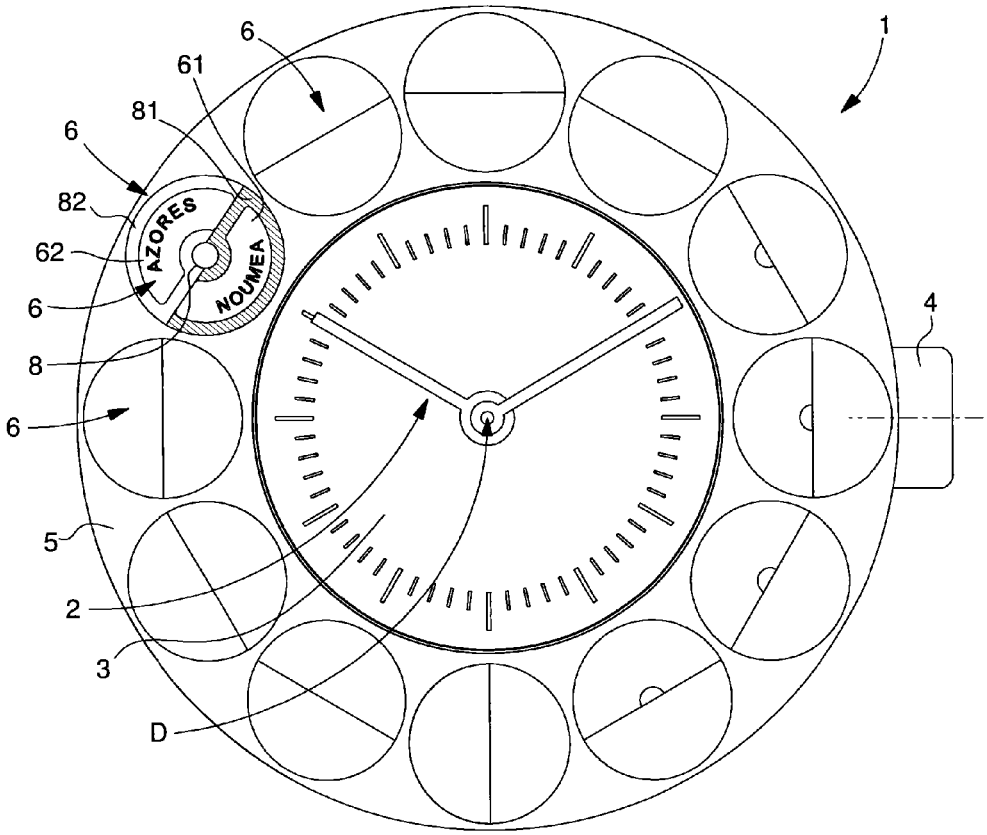
FIG. 1 shows a schematic, front view of a universal watch comprising a mechanism according to the invention, with a centred main time display, surrounded by a ring called the "city ring" carrying, on twelve positions, geographical reference points, each position carrying two of said reference points corresponding to diametrically opposite time zones. At the ten o'clock angular position there is shown a pivoting screen comprising a first area identifying the day and a second area identifying the night. The "Azores" geographical zone is displayed as being in the "day" position and the "Noumea" zone as being in the "night" position.

The invention concerns a universal watch 1 comprising a movement 10 for driving a main time display means 2, such as a hand or set of hands, cooperating with a complementary main display means 3 such as a dial, based on a main period.

This watch 1 includes a means 4 of adjusting the main time display means 2 to set the current time of a determined place.

Watch 1 further includes a secondary display means 5 that is moveable relative to the complementary main time display means 3. This secondary display means 5, shown in the Figures in the non-limiting form of a ring, concentric with dial 3, comprises a plurality of geographical reference points 6 corresponding to different time zones. This secondary display means 5 has its own period, which is preferably chosen to be equal to the main period. In the embodiment illustrated in the Figures, this secondary display means 5 is called the "city ring".

Movement 10 directly or indirectly drives, in a synchronous manner with main time display means 2, both secondary display means 5 and a carrier structure 7. According to the invention, this carrier structure 7 carries a plurality of first screens 8: each screen is superposed on one of geographical reference points 6 and is capable of occupying several different positions according to the time of day, and changes from one position to another under the action of a first drive means 9, which imparts on said screen a torque or drive force greater than, respectively, a torque or resistant force imparted thereon by first friction means 11 connected to carrier structure 7. In a preferred embodiment of the invention, illustrated in the Figures, each first screen 8 thus alternately occupies two stable positions, and preferably changes from one to the other by pivoting. Each first screen 8 changes from one of its positions to the other based on a secondary period, which is preferably an integer sub-multiple of the main period or is equal to the main period.

In a preferred application illustrated in the Figures, each geographical reference point 6 is linked with a given terrestrial meridian plane, and includes a first reference point 61 linked to a given time zone, and a second reference point 62 linked to the time zone diametrically opposite the preceding given time zone. For example, these reference points are formed by the names of states or cities. This arrangement enables a single angular sector of secondary display means 5 to be allocated to two diametrically opposite time zones, and thus enables all the time zones to be displayed on only twelve angular sectors, which makes the watch easy to read.

Preferably, and as illustrated in the Figures, each first screen 8 includes a first area 81 and a second area 82, each area 81, 82 being alternately superposed on first reference point 61 and on second reference point 62. In the example embodiment illustrated in the Figures, each area 81, 82 is a half disc.

In the preferred application illustrated in FIGS. 1 to 6 which concern the combination of a permanent day-night display with a permanent time zone time display, the first drive means 9 drives each screen 8 once per twelve hour period.

Thus, the timepiece forming the subject of this specification is a conventional watch 1, with a time display over a twelve hour period, and one revolution of secondary display means 5, here a city ring, in this same twelve hour period. However, this twelve hour period is non-limiting and the invention may be implemented with a different period, particularly twenty-four hours, in which case it is easy to adapt the invention so that drive means 9 drives each screen 8 two times per twelve hour period. Naturally it is possible to select other main periods for the watch, and other secondary periods for secondary display 5 by suitably adapting first drive means 9, for example to display quarter-hour changes on a ship, or work station changes in a facility in continuous operation or similar, where it is easily possible, with the invention, to see which team is on standby or active at a work station; secondary durations of 1, 2, 3, 4 and 6 hours can thus very easily be displayed both with a main period of twelve hours and of twenty-four hours.

Preferably, in the embodiments illustrated here, first drive means 9 is positioned so as to cause motion of only one first screen 8 at a time, in a pivoting motion at an angle of constant value, which is 180° in the case of the particular example illustrated in the Figures, relative to a pivot axis in a fixed position relative to carrier structure 7, the pivoting motion of screen 8 being realised once per main period (twelve hours here). The secondary period is also twelve hours here.

In this embodiment, chosen for a day/night display, first drive means 9 is positioned to cause the pivoting motion at 0600 hours and at 1800 hours in the local times of two time zones covered by the same meridian plane linked to a given geographical reference point 6. Thus, the geographical reference point 6 including two cities appertaining to the same meridian plane but of opposite time zones, for example in the Figures, Noumea at the first reference point 61 and the Azores at the second reference point 62, is covered by a screen 8 which pivots when it is 0600 hours in the Azores, at the start of the day, and 1800 hours in Nouméea at the start of the night. Twelve hours later, this same dial 8 pivots again, when it is 1800 hours in the Azores, at the start of the night, and 0600 hours in Nouméea, at the start of the day.

Figure 5:
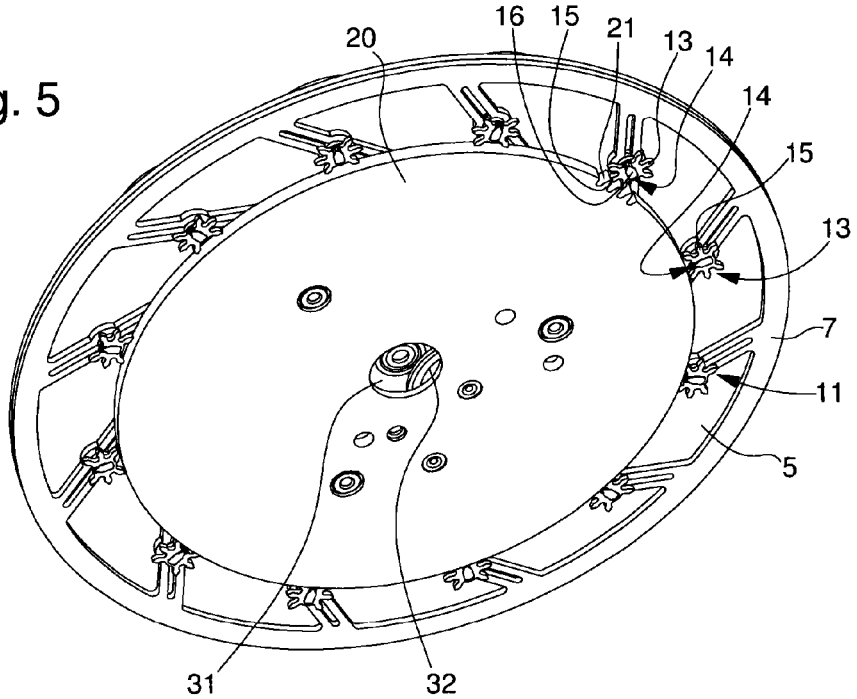
FIG. 5 shows the same mechanism, seen in the same manner as in FIG. 3, and showing the angular position of each of the twelve truncated pinions comprised therein, each covering a 30° angular sector.

To cause the motion of screen 8, which is preferably a pivoting motion, first drive means 9 advantageously includes at least one first toothed sector 21 surrounded by first smooth portions 26 on a first edge 27 of a plate 20 of watch 1, or of a fixed component set in position on said plate. Each first screen 8 is pivotally moveable relative to carrier structure 7 and integral with a first truncated pinion 13 which moves by sliding or rolling on said first edge 27. The first truncated pinion 13 includes at least a first toothing 15 interrupted by at least a first recess 14, and the first truncated pinion 13, according to the position of carrier structure 7, either slides without pivoting, resting via a first recess 14 on a first smooth portion 26, or pivots under the effect of the meshing of a first toothing 15 with a first toothed sector 21. FIG. 5 shows first truncated pinions 13, which each comprise two first toothings 15 having three teeth, separated by two first recesses 14 which correspond to two stable display states of screen 8 carrying this first truncated pinion 13. The first toothed sector 21 includes just enough teeth hollows and teeth to cause the associated first truncated pinion 13 to roll and pivot.

In particular, in the application described, the number of teeth of the first toothed sector 21 and the number of teeth of the first toothing 15 are arranged to cause the first truncated pinion 13 to pivot at an angle of 180° when it rolls past over the first toothed sector 21.

Advantageously, on each first screen 8, carrier structure 7 includes elastic arms 17 which clamp a first arbour 16 driving the first screen 8, and which form the first friction means 11.

Advantageously, as seen in FIG. 5, these elastic arms 17 together form an inclined arm 18, which tends to exert a pressing force on the first toothed pinion 13 carried by arm 18, to press on the first edge 27 of plate 20.

In an advantageous embodiment, the means 4 of adjusting the main time display means 2 to set the time of a determined place includes a mechanism for changing time zone by adding or subtracting an integer number of hours. This mechanism is not described in detail here and is known to those skilled in the art.

Figure 6:
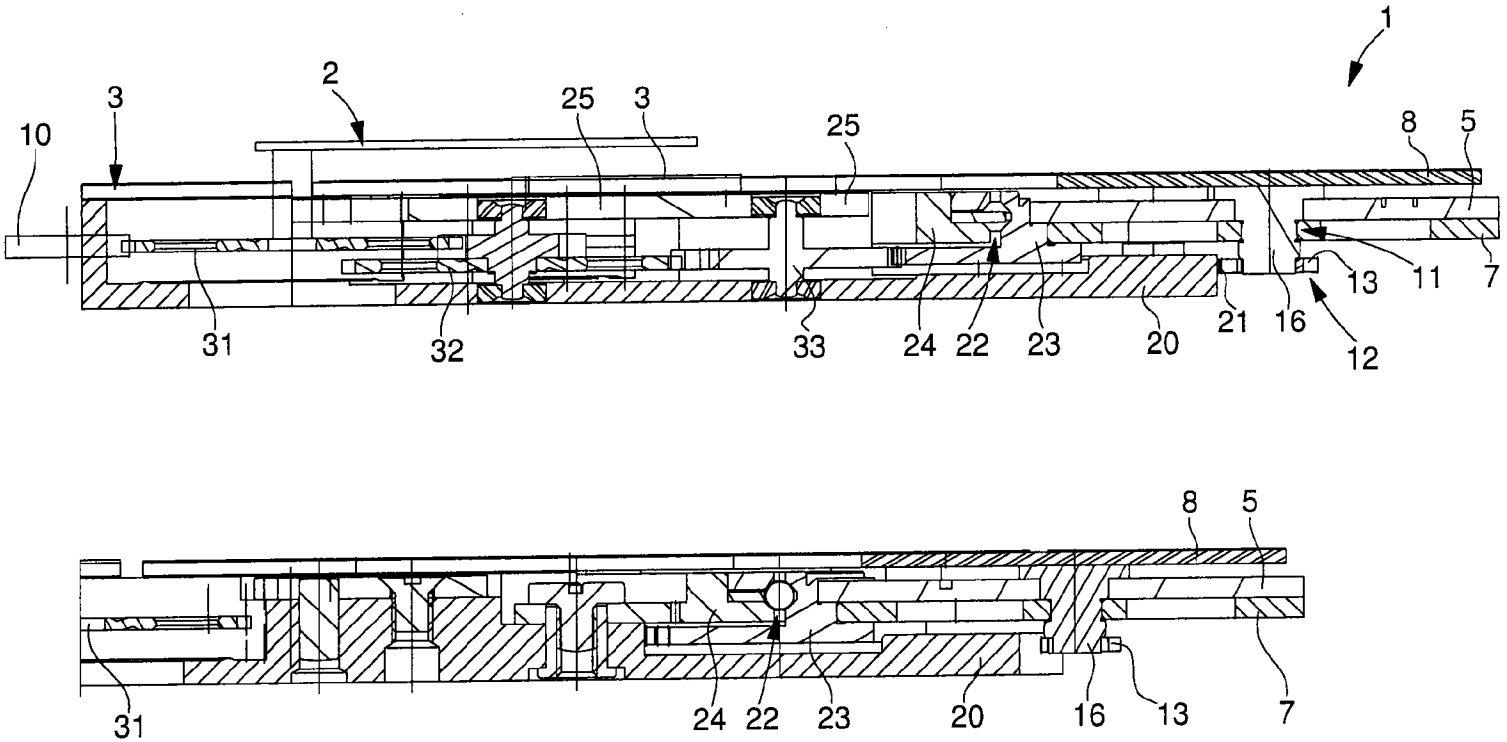
FIG. 6 shows two partial diametral sections of the mechanism, one where the truncated pinion meshes with the toothed sector of the plate, and the other where the truncated pinion slides over a smooth sector of the plate.

In the preferred embodiment shown in FIG. 6, movement 10 drives the secondary display means 5 and also a carrier structure 7 via a gear train (including an hour wheel 31 here, driving an intermediate wheel set 32, driving an intermediate wheel 33) driving a toothed moveable ring 23 forming a cage for a ball bearing 22, another cage 24 of which is secured to a fixed portion of watch 1. This toothed moveable ring 23 carries carrier structure 7 and secondary display means 5.

Figure 7:
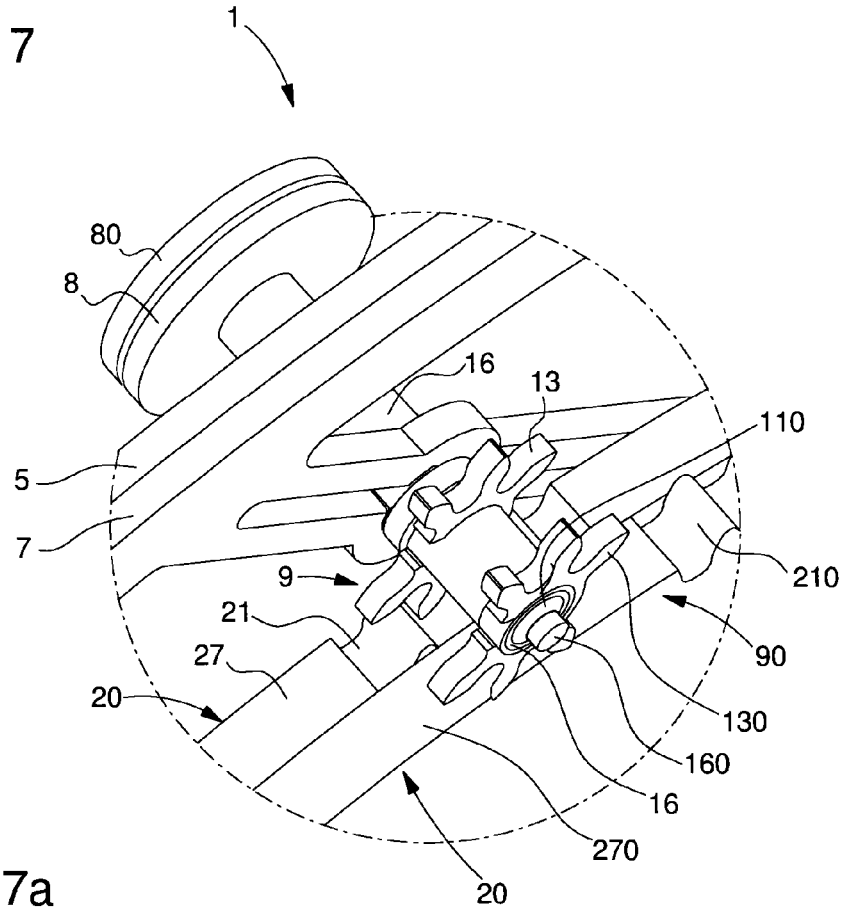
FIG. 7 shows an extrapolation to a mechanism displaying both a first day/night indication and a second indication, for example AM/PM, using two superposed screens. One detail of the mechanism is shown in perspective, with two concentric plates comprising toothed sectors that are angularly shifted relative to each other, on which two coaxial truncated pinions can roll, each controlling one screen. This Figure is supplemented, in FIG. 7*a*, by examples of displayed information visible to the user.
Figure 8:
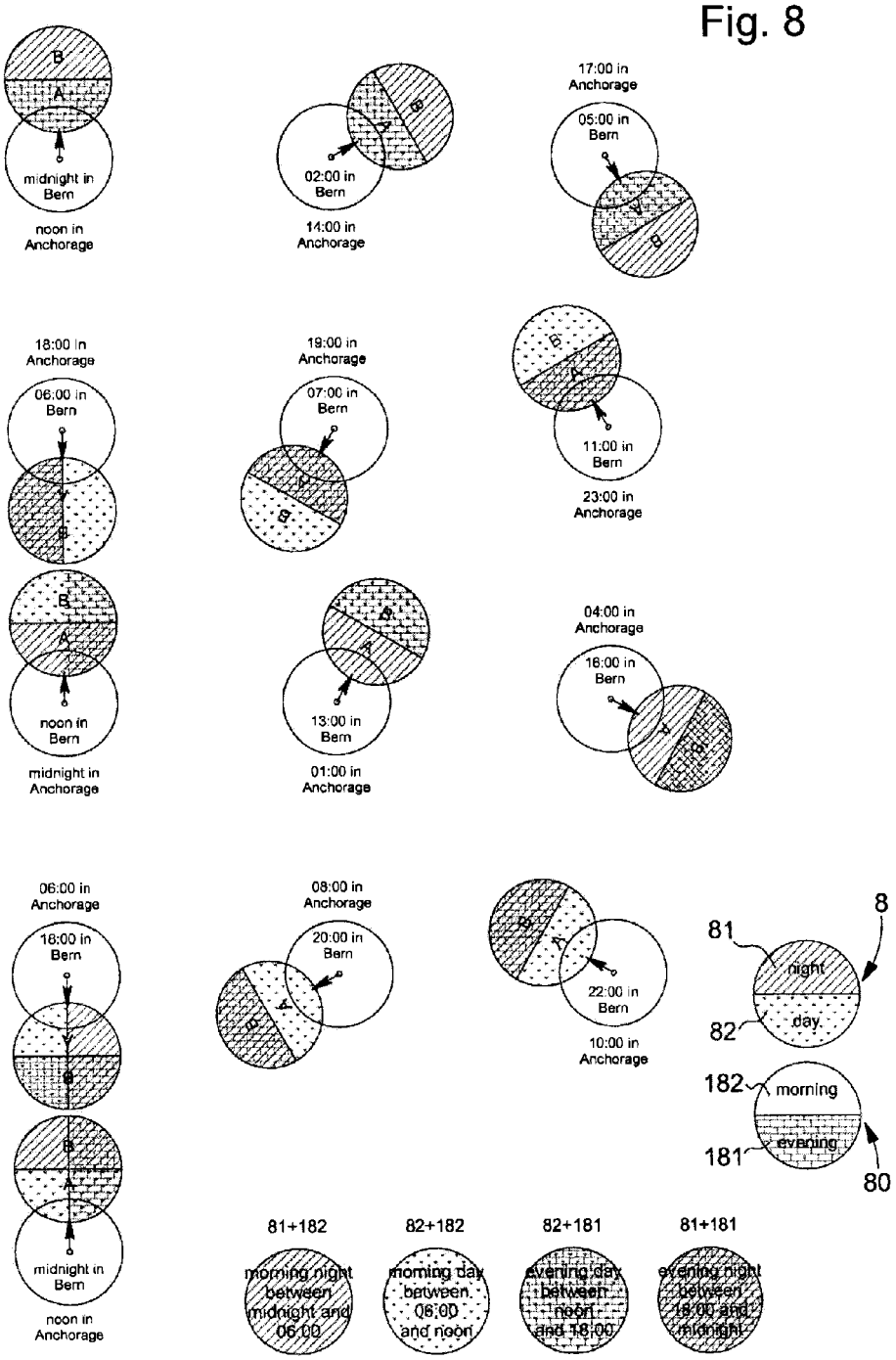
FIG. 8 illustrates diagrams of the "Bern"/"Anchorage" pair at different times of the day and night.

In a particular embodiment seen in FIGS. 7 and 8, the invention combines the display of several pieces of information for the same geographical reference point 6. Therefore, each first screen 8 is coaxial to at least one second screen 80, also superposed on the same geographical reference point 6. This second screen 80 is capable of occupying several different positions according to the time of day, and changes from one position to the other under the action of a second drive means 90 imparting thereon a torque or drive force greater than, respectively, a torque or resistant force imparted thereon by a second friction means 110 connected to an arbour 16 carrying the first screen 8 concerned.

In this particular embodiment, each second screen 80 includes a first area 181 and a second area 182, each area 181, 182 being alternately superposed on first reference point 61 and on second reference point 62.

Advantageously, to provide an easy-to-read display for the user, first area 81 and second area 82 of first screen 8 and first area 181 and second area 182 of second screen 80 are transparent or translucent, and coloured and/or polarized so that the four superposed positions are optically different for the user.

Figure 7A:
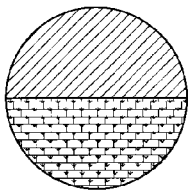
Figure 7A:
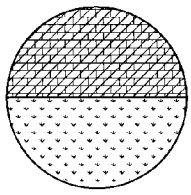
Figure 7A:
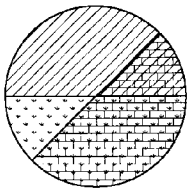
Figure 7A:
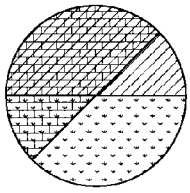

FIGS. 7A and 8 illustrate display examples. In this example, as seen in FIG. 8, the first area 81 of screen 8 is blue (shown in hatching in the Figures), and represents the night, and second area 82 is yellow (decorated with grass in the Figures) and represents the day. In the illustrated case where the second screen 80 is an AM/PM display changing at midday, respectively midnight, for each time zone, with the same secondary period of 12 hours, the first area 181 is red (decorated with bricks in the Figures) and represents the evening PM, whereas the second area 182 is white (shown without any decoration in the Figures) and represents the morning. Thus, the superposed positions result in very distinct colours, which are easy for the user to interpret: blue from 2400 hours to 0600 hours, yellow from 0600 hours to 1200 hours, orange from 1200 hours to 1800 hours and violet from 1800 hours to 2400 hours, as seen at the bottom of FIG. 8.

Figure 2:
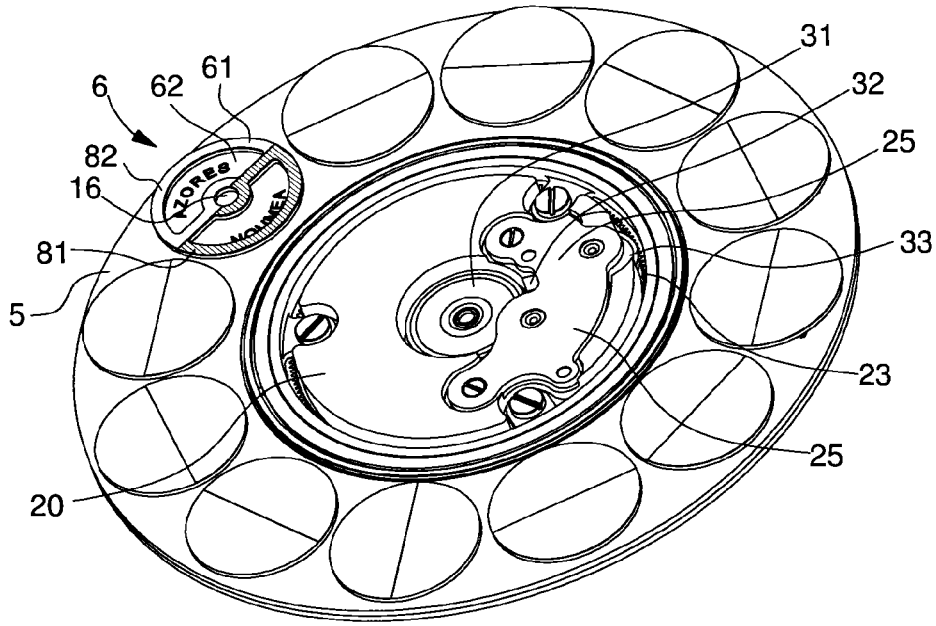
FIG. 2 shows a schematic, perspective view of the front face of the mechanism of FIG. 1, with the main display having been removed.
Figure 3:
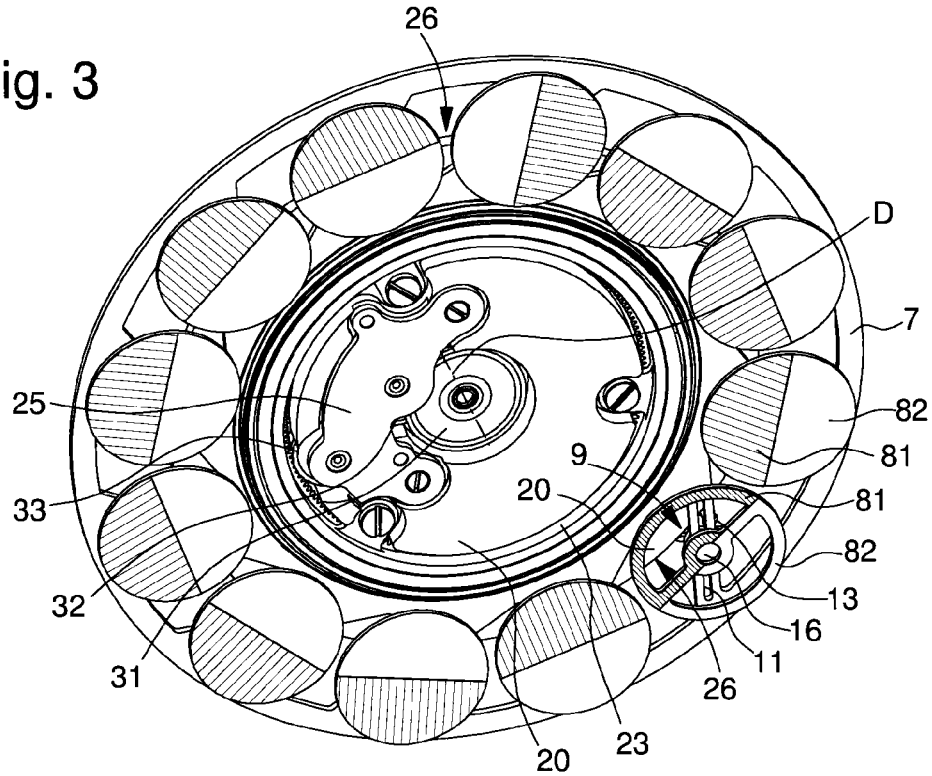
FIG. 3 shows the same mechanism, with the city ring removed compared to FIG. 2, so as to reveal a carrier structure, which includes double elastic arms, obliquely mounted relative to the radial lines. Between each pair of arms there is friction-inserted arbour of a truncated pinion sliding or rolling on the edge of a plate. The same arbour carries one of the pivoting screens.
Figure 4:
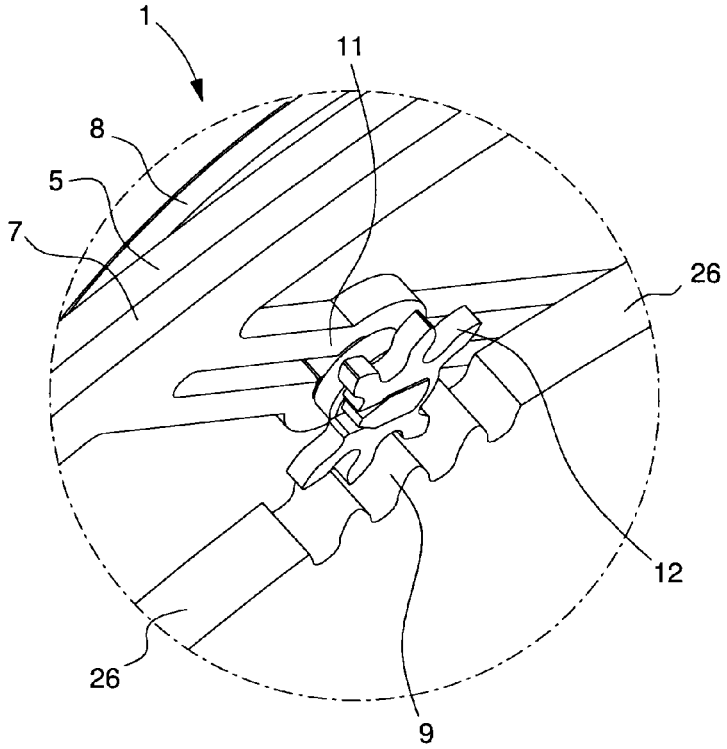
FIG. 4 shows a detail of the same mechanism, seen from the opposite side to FIG. 3, and showing the cooperation of a truncated pinion with a toothed sector comprised in said plate, for pivoting the arbour of the truncated pinion when its toothing meshes with said toothed sector and rolls relative to the plate.

FIG. 7*a*illustrates these superposed positions: in FIG. 7*a*1, night and morning in the top semi-circle, day and evening in the bottom semi-circle. In FIG. 7*a*2, night and evening in the top semi-circle, day and morning in the bottom semi-circle. In FIG. 7*a*3, an intermediate position, with a night sector above a 3 o'clock-9 o'clock axis, and a morning sector above a 2 o'clock-8 o'clock axis, namely the series of indications: from 0 to 2 o'clock night and morning, from 2 to 3 o'clock night and evening, from 3 to 8 o'clock day and evening, from 8 to 9 o'clock day and morning, from 9 o'clock to 12 o'clock night and morning. Likewise, in FIG. 7*a*4, an intermediate position, with a night sector above a 3 o'clock-9 o'clock axis, and an evening sector above a 2 o'clock-8 o'clock axis, namely the series of indications: from 0 to 2 o'clock night and evening, from 2 to 3 o'clock night and morning, from 3 to 8 o'clock day and morning, from 8 to 9 o'clock day and evening, from 9 o'clock to 12 o'clock night and evening. This display is repeated in FIG. 8, which details the time indication in Bern (B) in a clear circle, the corresponding time in Anchorage (A), and the corresponding position of the display sectors and the indications displayed by said sectors.

The change of position of the day/night indicator is shown when it is 0600 hours in Bern, the change of position of the morning/evening (AM/PM) indicator when it is midday in Bern, the change of position of the day/night indicator when it is 1800 hours in Bern, the change of position of the morning/evening indicator (or AM/PM) when it is midnight in Bern.

In a variant that is not illustrated, the first area 81 and second area 82 of first screen 8 are pierced and ringed with a different colour or pattern, as seen in FIGS. 1 to 3. First area 181 and second area 182 of the second screen 80 have a different diameter, to make them highly visible. It is also possible to mix the two display modes, with a coloured transparent screen and a pierced frame.

In this same variant, the second drive means 90 is positioned so as to cause a motion of only one second screen 80 at a time, in a 180° pivoting motion relative to a pivot axis whose position is fixed relative to carrier structure 7, the pivoting motion being realised once per twelve hour period.

As explained above, to achieve an AM/PM display, the second drive means 90 is positioned to cause the pivoting motion at 1200 hours and at 2400 hours in the local times of the two time zones covered by the same meridian plane to which a given geographical reference point 6 is linked.

Naturally, the invention is applicable to timepieces other than a watch, particularly to pendulums or clocks.

Thus the invention provides an easy-to-read display of universal time, without any risk of error. It is possible to read the 24 reference time zones instantly and to know whether it is day or night.

The mechanism is compact and very simple to operate. The mechanism with truncated pinions ensures that the display disc is properly locked and prevents any accidental pivoting, for example in the event of a shock.

What is claimed is:

1. An universal watch comprising a movement for driving a main time display means cooperating with a complementary main time display means, and comprising a means of adjusting said main time display means to set the time of a determined place, and further comprising a secondary display means which is moveable relative to said complementary main time display means, said secondary display means comprising a plurality of geographical reference points corresponding to different time zones, said movement directly or indirectly driving both said secondary display means and a carrier structure, in a synchronous manner to said main time display means, wherein said carrier structure carries a plurality of first screens each superposed on one of said geographical reference points and capable of occupying several different positions according to the time of day and changing from one position to the other under the action of a first drive means imparting a torque or drive force thereon greater than, respectively, a torque or resistant force imparted thereon by a first friction means connected to said carrier structure.

2. The universal watch according to claim 1, wherein each said geographical reference point is linked to a given meridian plane and includes a first reference point linked to a given time zone, and a second reference point linked to the diametrically opposite time zone to the preceding given time zone, and wherein each said first screen includes a first area and a second area, each said area being alternately superposed on said first reference point and on said second reference point.

3. The universal watch according to claim 1, wherein said first drive means is positioned so as to cause a motion of only one said first screen at a time, in a 180° pivoting motion relative to a pivot axis whose position is fixed relative to said carrier structure, said pivoting motion being realised once per twelve hour period.

4. The universal watch according to claim 1, wherein said first drive means is positioned so as to cause a pivoting motion at 0600 hours and at 1800 hours in the local times of two time zones covered by the same meridian plane to which a said given geographical reference point is linked.

5. The universal watch according to claim 1, wherein said first drive means includes at least a first toothed sector framed by first smooth portions on a first edge of a plate of said watch, and wherein each said first screen is pivotally moveable relative to said carrier structure and integral with a first truncated pinion moving by sliding or rolling over said first edge, said first truncated pinion including at least a first toothing interrupted by at least a first recess, and wherein, according to the position of said carrier structure, said first truncated pinion either slides without pivoting, resting via a said first recess on a said first smooth portion, or pivots under the effect of a said first toothing meshing with a said first toothed sector.

6. The universal watch according to claim 5, wherein the number of teeth of said first toothed sector and the number of teeth of said first toothing are devised to cause said first truncated pinion to pivot 180° when said pinion rolls over said first toothed sector.

7. The universal watch according to claim 1, wherein, on each said first screen, said carrier structure includes elastic arms clamping a first arbour for driving said first screen, and forming said first friction means.

8. The universal watch according to claim 1, wherein said means of adjusting said main time display means for setting the time of a determined place comprises a mechanism for changing time zone by adding or subtracting an integer number of hours.

9. The universal watch according to claim 1, wherein said movement drives said second display means in addition to a carrier structure via a gear train driving a toothed moveable ring forming a cage for a ball bearing, another cage of which is fixed to a fixed portion of said watch, and wherein said toothed moveable ring carries said carrier structure and said secondary display means.

10. The universal watch according to claim 1, wherein each said first screen is coaxial to at least one second screen also superposed on the same said geographical reference point, said second screen being capable of occupying several different positions according to the time of day, and changing from one position to another under the action of a second drive means imparting thereon a torque or drive force greater than, respectively, a torque or resistant force imparted thereon by a second friction means connected to an arbour carrying said first screen concerned.

11. The universal watch according to claim 10, wherein each said first and second screen includes a first area and a second area, each said area being alternately superposed on said first reference point and on said second reference point.

12. The universal watch according to claim 11, wherein said first area and said second area of said first screen and said first area and said second area of said second screen are transparent or translucent, and are coloured and/or polarised so that the four superposed positions are optically different for the user.

13. The universal watch according to claim 10, wherein said second drive means is positioned so as to cause a motion of only one said second screen at a time, in a 180° pivoting motion relative to a pivot axis whose position is fixed relative to said carrier structure, said pivoting motion being realised once per twelve hour period.

14. The universal watch according to claim 13, wherein said second drive means is positioned so as to realise said pivoting motion at 1200 hours and at 2400 hours in the local times of two time zone covered by the same meridian plane to which a said given geographical reference point is linked.

* * * * *